US005626370A

United States Patent [19]

Petkovsek

[11] Patent Number: 5,626,370

[45] Date of Patent: May 6, 1997

[54] ONE-PIECE SPECIAL SERVICE MAILING FORM AND RETURN ENVELOPE AND A METHOD FOR ASSEMBLING SAME

[75] Inventor: Glenn Petkovsek, 20 Tortoise Park Cove, Little Rock, Ark. 72211-2349

[73] Assignee: Glenn Petkovsek, Little Rock, Ark.

[21] Appl. No.: 353,621

[22] Filed: Dec. 12, 1994

[51] Int. Cl.[6] ..... B42D 15/00

[52] U.S. Cl. ..... 283/116

[58] Field of Search ..... 283/56, 61, 62, 283/116, 117, 79, 81

[56] References Cited

U.S. PATENT DOCUMENTS 3,987,960 10/1976 Gardiner ..... 283/79 X
4,616,852 10/1986 Cash ..... 283/56 X
4,915,287 4/1990 Volk et al. ..... 283/56 X
5,333,909 8/1994 Hedge, Jr. ..... 283/56
5,421,778 6/1995 Kourmanis ..... 283/79 X
5,476,420 12/1995 Manning ..... 283/116 X

*Primary Examiner*—Willmon Fridie, Jr.
*Attorney, Agent, or Firm*—Hill, Steadman & Simpson

[57] ABSTRACT

A combined assembly and a method are provided for delivering a mailing attached to an article requiring special services. A form resembling a return postcard acting as a receipt for the delivery employee is integrally attached to an envelope capable of receiving a payment in a compartment of the envelope. The combined form and envelope is attachable to an article and removable therefrom upon delivery. The address receipt section is also provided but may be retained on the article following removal of the envelope and return form.

18 Claims, 8 Drawing Sheets

ONE-PIECE SPECIAL SERVICE MAILING FORM AND RETURN ENVELOPE AND A METHOD FOR ASSEMBLING SAME

BACKGROUND OF THE INVENTION

The present invention generally relates to a combination form and envelope. More specifically, the present invention relates to a combination form required for mailing of an article requiring special services, particularly a mailing requiring cash on delivery (COD), and an associated return envelope.

It is, of course, generally known to provide forms and envelopes for mailing an article requiring special services, such as cash on delivery (COD). However, such known forms and envelopes for completing mailing of the article requiring special services are typically non-integrally related. Therefore, a mail delivery person delivering the article, the post office or other mailing facility requires separately stocking multiple forms and multiple envelopes for completing the special services mailing.

Furthermore, the delivery personnel must be aware of all forms which must be completed in order to successfully complete all of the requirements for the particular mailing. For example, to mail an article requiring cash on delivery, a receipt must be given to the sender, the addressee and the delivery personnel. Further, a check, cash, or money order must be received by the delivery person upon delivery of the article for which the receipt is written. Appropriate labelling and amounts must be entered on the forms, receipts and/or envelopes to identify the amount of money received upon delivery as well as to track the given article with specific amounts of cash and receipts therefor.

The COD mailing can be, therefore, both time-consuming and ineffective to correctly complete the same since stocking of appropriate forms for the delivery person is required and further given the number of steps required to complete the mailing. This is particularly true from an addressee's viewpoint as the process may be unfamiliar. Also, assurance that each form is completed by an appropriate person, returned to an appropriate person and received by an appropriate person are all required to successfully complete the delivery of an article requiring cash on delivery.

A need, therefore, exists for an improved combination form and envelope, particularly for COD mailings, but that is also suitable for other mailing requiring special services.

SUMMARY OF THE INVENTION

The present invention provides a combination envelope and form, particularly for COD mailing, but suitable for other mailing requiring special services or other areas in which multiple tasks may be required to complete a transaction associated with mailing of an article.

To this end, in an embodiment of the present invention, an assembly is provided for delivering a mailing attached to an article requiring special services. The assembly has a form capable of being printed with information related to the special services required for the mailing of the article. A return envelope is detachably connected to the form having an interior compartment. Means are provided for securing the form and the return envelope as an integral combination to the article for delivery.

In an embodiment, a first receipt portion is detachably connected to at least one of the form and the return envelope.

In an embodiment, perforated tear lines between the form and the return envelope selectively detach one from the other.

In an embodiment, a label is removably secured to the form.

In an embodiment, a second receipt portion is detachably connected to the return envelope. A plurality of sections define the second receipt portion wherein at least one of the plurality of sections has a contrasting background shade.

In an embodiment, a flap is integrally formed with the return envelope capable of enclosing the interior compartment of the envelope.

In an embodiment, machine readable indicia are provided on a portion of the form identifying the mailing.

In an embodiment, a plurality of sections define the form wherein at least one of the plurality of sections is a contrasting background shade.

In an embodiment, the required special service of the assembly of the present invention is cash on delivery.

In another embodiment of the present invention, a method is provided for delivering a mailing attached to an article requiring special services. The method comprises the steps of: providing an envelope having an interior compartment; providing a form integral with the envelope and removably attached thereto; and securing the envelope and the form as a unit to the article for delivery.

In an embodiment, the method further comprises the step of providing a return receipt portion removably attached and integral with the unit.

In an embodiment, the method further comprises the step of providing an adhesive area to secure the unit to the area.

In an embodiment, the method further comprises the step of removing the envelope and the form from the article following delivery.

In an embodiment, the method further comprises the step of providing a flap integral with the envelope to selectively enclose the envelope.

In an embodiment, the method further comprises the step of providing a removable label on the form.

In an embodiment, the method further comprises the step of folding the envelope against the form prior to securing to the article for delivery.

In an embodiment, a combined assembly for mailing of an article requiring special services is provided. The assembly has a first portion providing a receipt for delivery personnel following mailing of the article requiring special services. An envelope is integrally formed with and detachably connected to the first portion forming a unit wherein the envelope has an interior compartment. A second portion is integrally formed with and detachable connected to the unit providing a receipt for an addressee of the article requiring special services. Means for securing the unit and the second portion to the article requiring special services is further provided.

In an embodiment, the combined assembly has a label removable from the first portion.

In an embodiment, the combined assembly has a third portion attached to the return envelope capable of removal therefrom and providing a receipt for the mailer of the article requiring special services.

In an embodiment, the envelope of the combined assembly is integrally formed between the first portion and the second portion.

It is, therefore, an advantage of the present invention to provide an assembly and a method for delivering a mailing attached to an article requiring special services.

Another advantage is to provide an assembly and a method for delivering a mailing attached to an article requiring special services that is simple to use.

Yet another advantage of the present invention is to provide an assembly and a method for delivering a mailing attached to an article requiring special services that is integrally formed.

Yet another advantage of the present invention is to provide an assembly and a method for delivering a mailing attached to an article requiring special services requiring no additional forms and/or envelopes to complete the special service.

Moreover, an advantage of the present invention is to provide an assembly and a method for delivering a mailing attached to an article requiring special services that is easy to apply to the article and remove from the article.

Yet another advantage is to provide an assembly and a method for delivering a mailing attached to an article requiring special services that is easily attachable and removable from the article to complete all steps of delivery of the article including indicating receipt of payment and/or indicating receipt of the article.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a combination form and envelope particularly suitable for effecting a cash on delivery (COD) mailing of an article. However, it should be understood that the present invention is not limited to COD mailing, but may be implemented for any mailing of an article requiring receipt, payment, or other verification of the mailing of the article.

Figure 1:
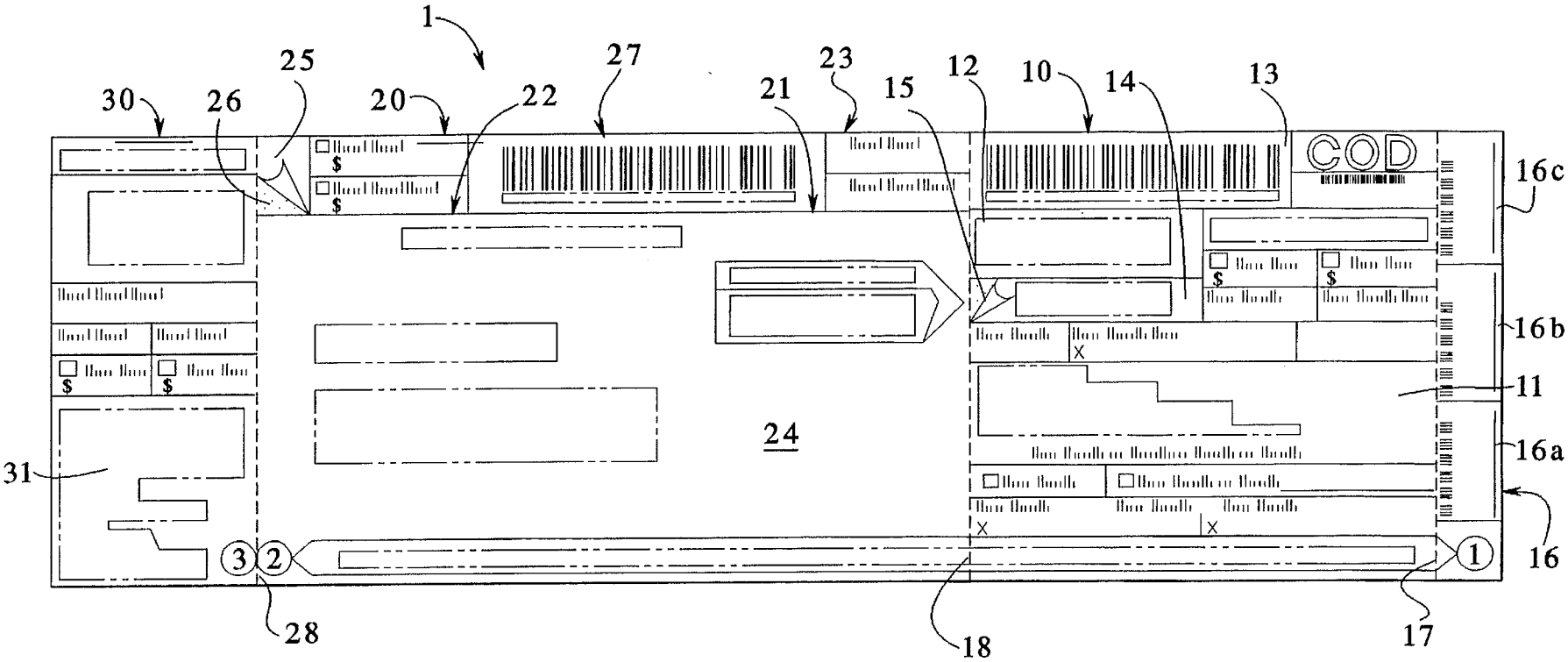
FIG. 1 illustrates a front plan view of an embodiment of a combination of an envelope and an associated form of the present invention.
Figure 2:
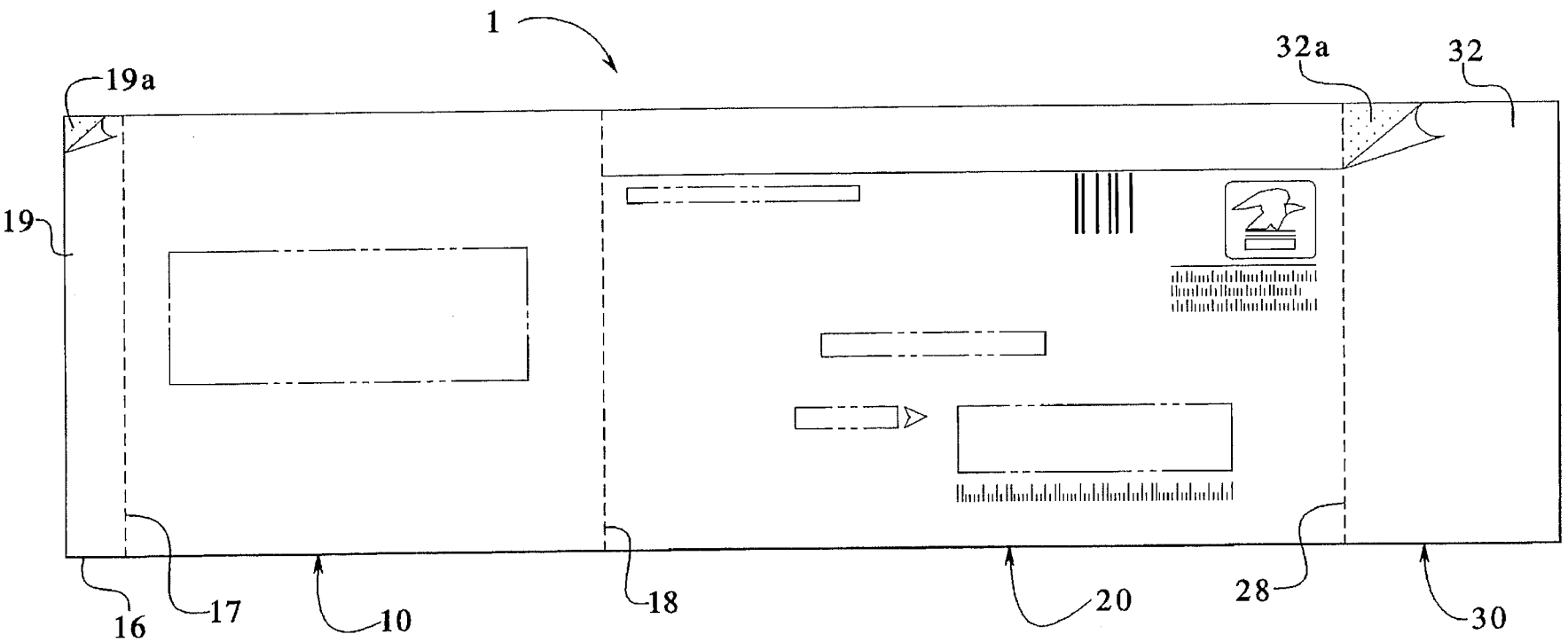
FIG. 2 illustrates a rear plan view of an embodiment of a combination of an envelope and an associated form of the present invention.
Figure 3:
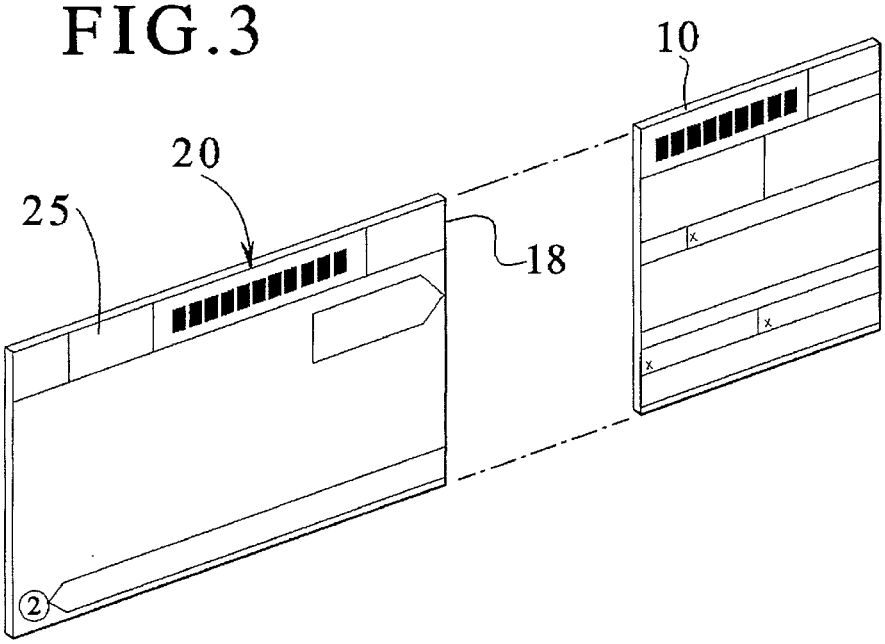
FIG. 3 illustrates a perspective view, partially exploded, of an embodiment of the form and envelope of the present invention.

Referring now to the drawings, wherein like numerals refer to like parts, FIGS. 1 and 2 illustrate the front and back side, respectively, of a complete COD mailer 1 in an embodiment of the present invention. The COD mailer 1 includes three primary parts: a return postcard 10; a return envelope 20; and an addressee receipt 30.

The return postcard 10 includes an addressee section 11 including a name and mailing address to whom the package, parcel or other like article is to be delivered. The return postcard 10 further includes an addressor section 12. The addressor section 12 is indicative of from whom the article is being sent.

Mailer identifying sections 13 and 14 are further provided as a part of the return postcard 10. The first mailer identifier section 13 includes an article identifying number corresponding to the number in the second mailer identifying section 14. In the mail identifying section 13, the number may be provided in machine readable format, such as a bar code or numerals written for detection/identification by optical character recognition (OCR) devices. Further, the background shading of the mailer identifying section 13 may be lighter than the other sections to improve readability of the characters by known devices and to readily identify the location of the mailer identifying section 13 on the return postcard 10. Likewise, the mailer identifier section 14 and the addressee section 11 may be shaded to contrast with the remainder of the return postcard 10. The addressee section 11 also includes optically recognizable characters and machine readable designators such that a contrasting shade in this section improves the detectability thereof.

The mailer identifying section 14 is provided with a peelable label 15. When an article is delivered to an individual, if a check or money order is provided by the addressee for the COD mailer, the peelable label 15 including the article identifying number is removed from the return postcard 10 and placed on either the check or money order to identify that the check or money order was received for the particular mailer with the article identifying number on the peelable label 15.

A delivery record section 16 is detachably provided on the return postcard 10. A perforated tear line 17 allows removal of the delivery record section 16 from the remainder of the return postcard 10. The delivery record section 16 includes, for example, three date recording sections **16*a*, 16*b* and 16*c*. Each of the sections 16*a*, 16*b*, 16*c* provides an area that allows a delivery employee to enter dates on which notice was given to the addressee of the article. One of the sections 16*a*, 16*b* or 16*c*** may be further used for inputting a date on which the article is returned as undeliverable.

A number of other sections are provided on the return postcard 10 to be completed both by the delivery personnel as well as the individual receiving the article. More specifically, sections may be provided, for example, to enter check amount, cash amount, check number, money order number, date delivered, date payment sent to mailer, a signature of the person by whom the article is delivered, a signature section for signature of the person by whom the article was received and the like.

Further, a perforated tear line 18 is provided between the postcard 10 and the return envelope 20. After delivery of the article to the addressee, the return postcard 10 is kept on file at the post office or other site from which responsibility for delivery of the article lies.

The return envelope 20 of the mailer 1 in an embodiment of the present invention as illustrated in FIGS. 1 and 2 includes an interior compartment 21 having an access opening 22 at a junction between a sealing flap 23 and a body 24 of the envelope 20. The sealing flap 23 includes a peelable section 25 removable to expose an adhesive 26 on the sealing flap 23 for sealing the interior compartment 21 of the return envelope 20 following insertion of the payment for the article by the addressee. The peelable section 25 also provides a receipt for confirmation to the sender of the article that receipt or completion of delivery of the article has been effected.

The peelable section 25, after appropriate sections are filled out, is inserted into the interior compartment 21 of the return envelope 20 with the COD payment. Like the return postcard 10, the peelable section 25 includes a mailer identifying section 27 having machine readable characters such as a bar code and/or optically recognizable characters. Further, the mailer identifying section 27, like the corresponding identifying section 13 of the return postcard 10, may be shaded in its background to contrast with the remainder of the peelable section 25 and further to enhance recognition and readability of the machine readable code and characters.

A perforated tear line 28 separates the return envelope 20 from the addressee receipt 30. The addressee receipt 30 remains attached to the article being mailed for receipt of the addressee of receipt of the article mailed. The addressee receipt 30 may include a number of sections including a section for identifying and entering the amount paid upon receipt of the article, a section for entering the article identifying number, as well as an instruction section 31 providing an addressee instruction for filing a claim should the article arrive damaged. Likewise, the return envelope 20 has instructions for the delivery personnel as to how delivery and payment of the article is to be effected as well as instructions for designating the article.

As illustrated in FIG. 2, on a back side of the mailer 1 are two peelable sections 19 and 32 exposing adhesive areas 19*a* and 32*a* thereunder. Therefore, upon removal of the peelable sections 19 and 32, the corresponding adhesive areas 19*a* and 32*a* may be used to attach the mailer 1 to the article being mailed, such as a package 2 as illustrated in FIG. 4.

A back side of the return postcard 10 includes instructions for the delivery personnel, such as a post office employee, upon delivery of the package 2 attached to the COD mailer 1. The return envelope 20 includes the appropriate information/instructions for returning payment to the sender. To this end, the address of the sender is printed in machine readable format through optically recognizable characters and/or bar codes. The return envelopes further includes appropriate postage for mailing of the return envelope 20 and a return address for the return envelope 20.

Figure 4:
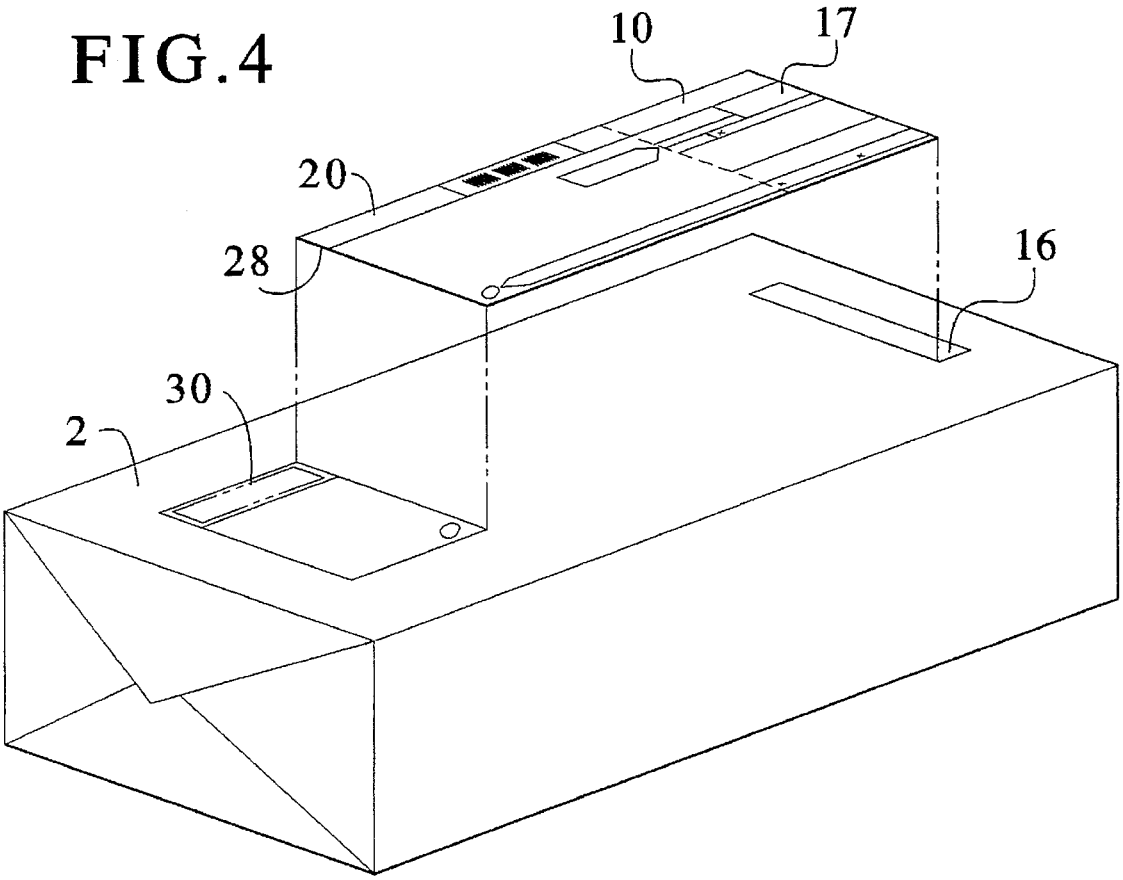
FIG. 4 illustrates a perspective view, partially exploded, of an environment in which the combination of an envelope and associated form are used for the present invention.
Figure 5:
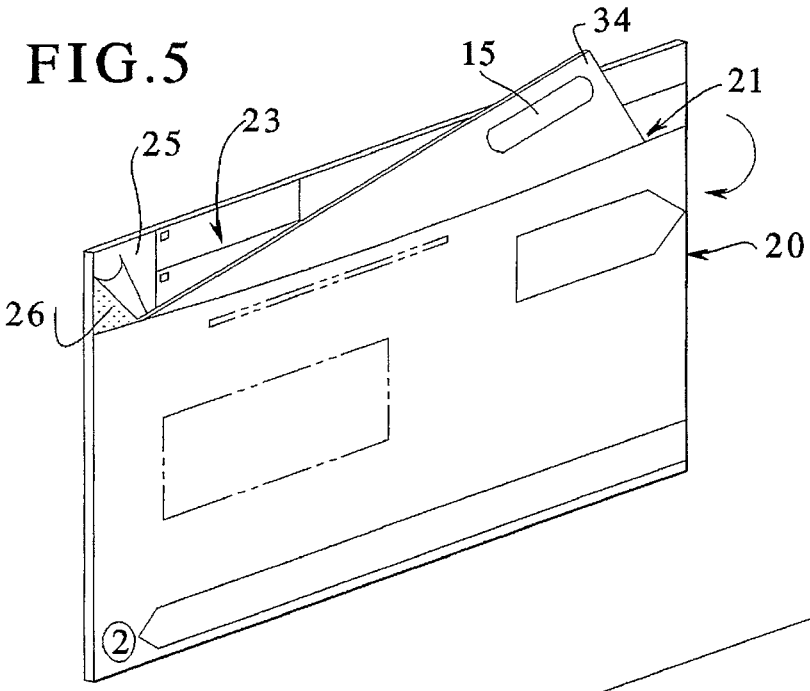
FIG. 5 illustrates a perspective view of one of the required components being inserted into the envelope in an embodiment of the present invention.

Referring now to FIGS. 3–7, a method for implementing mailing of the package 2 is illustrated, particularly the steps necessary after receipt of the package 2 by the addressee. As shown in FIG. 4, following receipt of the package to the addressee, the return envelope 20 and the return postcard 10 are removed from the package 2. The addressee 30 and the delivery record section 16 remain attached to the package due to the adhesive areas 19*a* and 32*a* on a reverse side of each of those sections. The perforated tear lines 17 and 28 assist in simple removal of the return postcard 10 and the return envelope 20 from the package 2.

Figure 6:
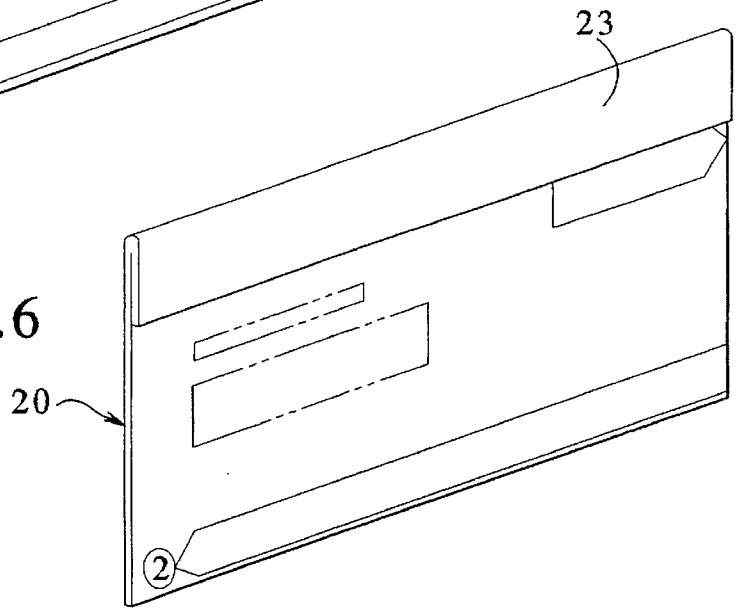
FIG. 6 illustrates a perspective view of a flap of the envelope sealed to enclose the required components into the envelope in an embodiment of the present invention.

Upon receipt of adequate payment and after completion of necessary sections of the return postcard 10 and the mailer identifying section 27 of the return envelope 20, the return postcard 10 may be removed from the return envelope 20 at the perforated tear line 18. A check or money order 34 is then inserted into an interior compartment 21 of the return envelope 20. The check or money order 34 includes the peelable label 15 having the article identifying number thereon. The peelable section 25 is then removed from the sealing flap 23 and inserted in the interior compartment 21 with the check or money order 34. Removal of the peelable section 25 from the sealing flap 23 exposes the adhesive 26 such that the flap 23 may be secured to the return envelope 20 as illustrated in FIG. 6.

Figure 7:
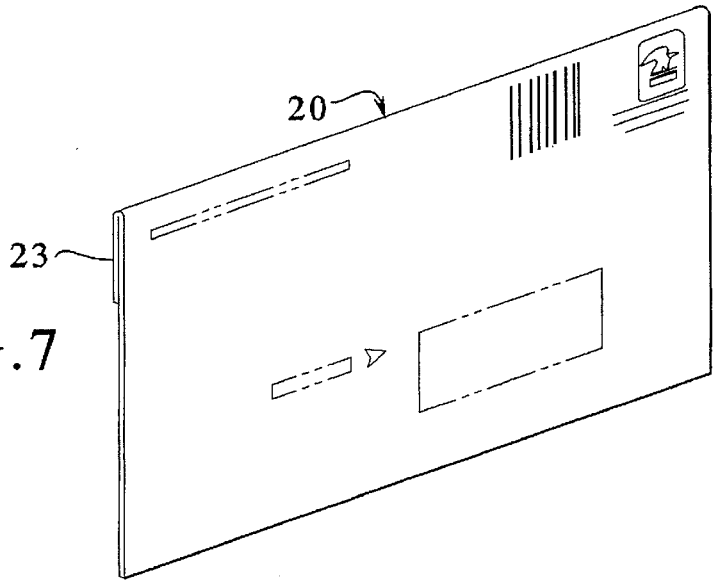
FIG. 7 illustrates a perspective view of a sealed envelope following assembly of an embodiment of the combination of the present invention.

FIG. 7 illustrates the front side of the completed return envelope suitable for mailing to the sender of the article including payment for the article and/or receipt of delivery of the article.

FIGS. 8–12 illustrate an alternate embodiment of a COD mailer 100 of the present invention. Again, the COD mailer 100 includes three primary parts: the return postcard 110; the return envelope 120; and the addressee receipt 130. The return postcard 100 is substantially identical to the return postcard 10 for the embodiment of the COD mailer 1 illustrated with reference to FIGS. 1–7. The return postcard 110 includes an addressee section 111, a mailer section 112, and mailer identifying sections 113 and 114. The mailer identifying section 114 includes a peelable label 115 with article identifying characters thereon. A delivery record section 116 is provided incorporating three parts 116*a*, 116*b* and 116*c* for recording of dates related to delivery of the mailer 100.

Figure 8:
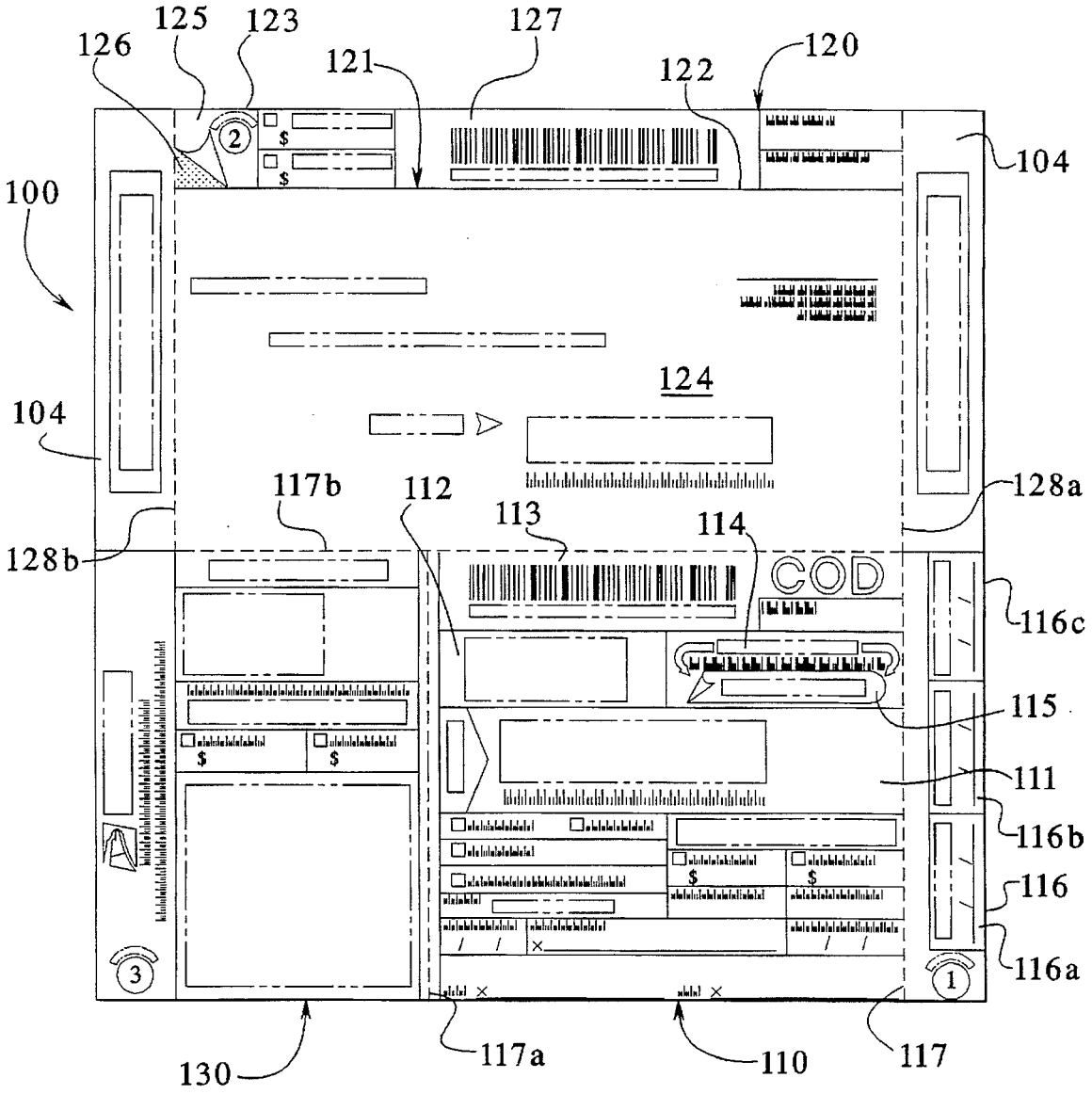
FIG. 8 illustrates a front plan view of an alternate embodiment of a combination of an envelope and associated form of the present invention.

In the embodiment illustrated in FIG. 8, the peelable label 115 is a portion of the mailer identifying section 114 and within the section 114 are instructions for removing the peelable label 115 and placing the same on a check or money order received from the addressee. The return postcard 110 also includes a number of other sections for completion by the delivery personnel before or upon delivery to the addressee. All of the sections, like the embodiment illustrated in FIGS. 1–7, may be shaded to indicate that certain items require completion upon delivery of the package 102 containing the COD mailer 100 thereon. For instance, one shade, such as yellow, may be used for shading appropriate areas requiring completion prior to delivery of the package 102. Another shade, such as red, may be used to indicate sections requiring completion upon delivery of the package 102 to the addressee. A third shade, such as white, may be used for sections containing optical recognizable characters or other machine readable characters, such as bar codes.

In the embodiment illustrated in FIG. 8, the delivery record section 116 is separable from the return postcard 10 by a perforated tear line 117. Further, a second perforated tear line 117*a* separates the return postcard 10 from the addressee receipt 130. A third perforated tear line 117*b* separates the combination of the return postcard 110 and the addressee 130 from the return envelope 120.

The addressee receipt 130 is substantially identical to the addressee 30 described with reference to FIGS. 1–7. Like the return postcard 110, the addressee receipt 130 may be appropriately shaded to identify a particular section relating to particular functions to be carried out by the delivery personnel. Further, certain areas or sections of the addressee receipt 130 containing optically recognizable characters may be shaded for simplifying reading and recognition of those characters by appropriate machine reading devices.

The return envelope 120 is substantially identical to the return envelope 20 described with reference to FIGS. 1–7. To this end, the return envelope 120 includes an interior compartment 121 accessible through an access opening 122 wherein the access opening 122 and the interior compartment 121 may be enclosed by a sealing flap 123. The sealing flap 123 includes a peelable section 125 exposing an adhesive 126 such that when the sealing flap 123 is folded at a junction of the sealing flap and a body 124 of the return envelope 120, the adhesive 126 attaches the flap 123 to the body 124 of the return envelope 120. The peelable section 125 includes a mailer identifying section 127 having machine-readable characters and/or a bar code for identifying the mailer 100. Perforated tear lines 128*a* and 128*b* are provided on each side of the return postcard 120 for removal of the remainder of the return postcard 120 from the mailer 100 when appropriate.

Figure 9:
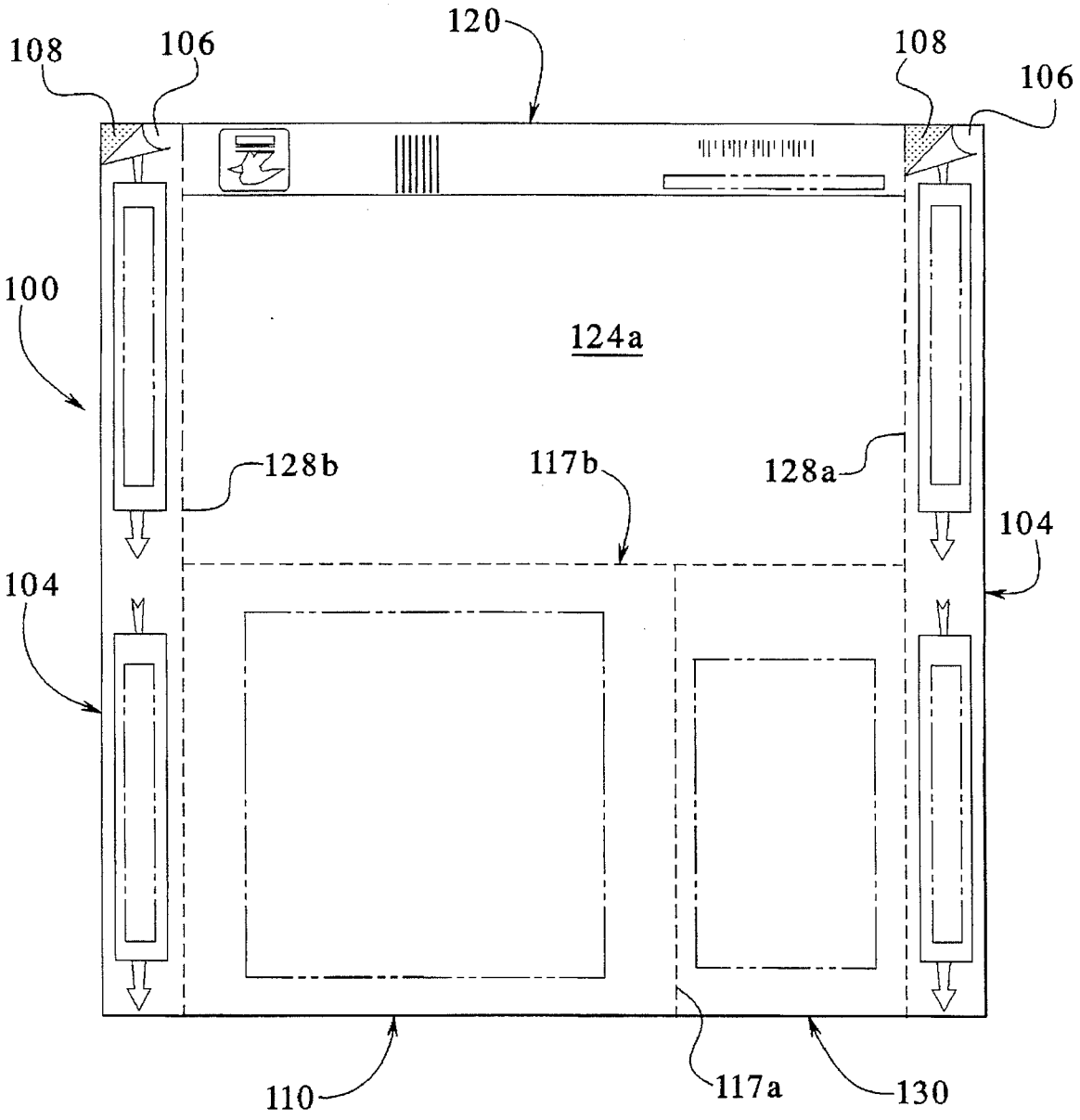
FIG. 9 illustrates a rear plan view of the embodiment illustrated in FIG. 8 of the combination of envelope and associated form of the present invention.
Figure 10:
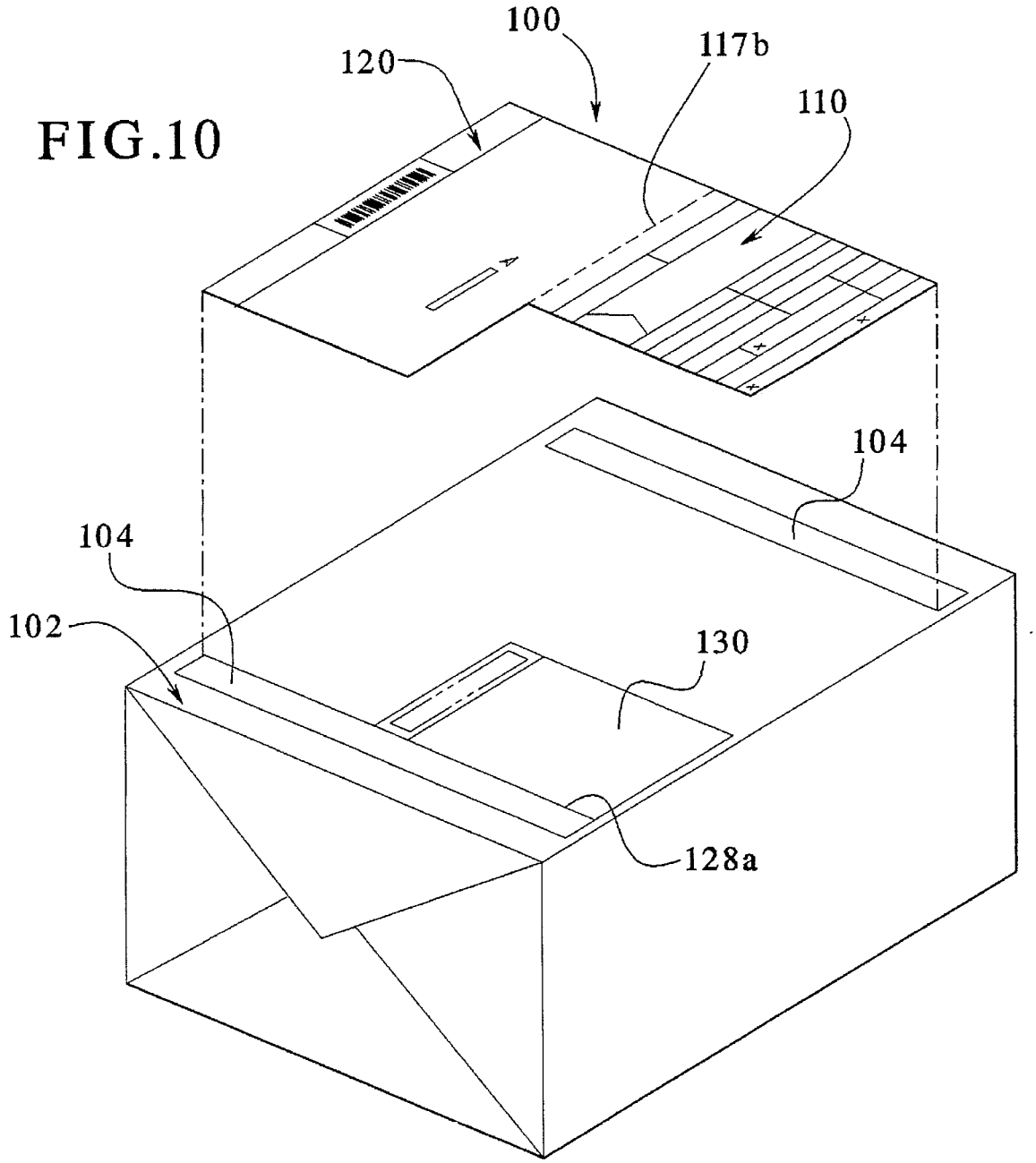
FIG. 10 illustrates a perspective, partially exploded, view of the combination illustrated in FIGS. 8 and 9 in an environment for the present invention.

Referring now to FIG. 9, the COD mailer 100 includes two strips 104 having peelable sections 106 exposing adhesive areas 108 for attaching the mailer 100 to the package 102 as illustrated in FIG. 10. Alternatively, the return envelope 120 may be detached from the strips 104 at the perforated tear lines 128*a* and 128*b*. Then, the return envelope 120 may be folded at the perforated tear line 117*b* such that a back side 124*a* of the envelope is opposite or beneath the combination of the return postcard 110 and the addressee receipt 130. This is particularly more suitable for small mailings such as the package 102 wherein a much smaller surface area is available for attachment of the mailer 100 to such a package.

Figure 11:
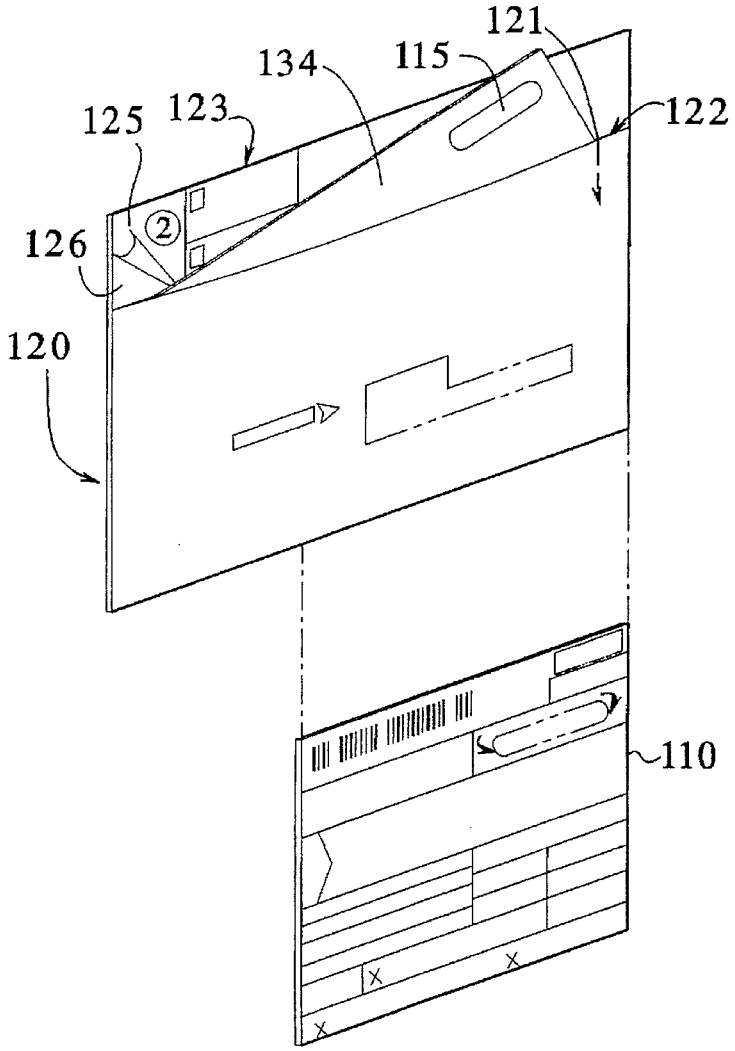
FIG. 11 illustrates a perspective view, partially exploded, of a component being inserted into an envelope of the present invention.
Figure 12:
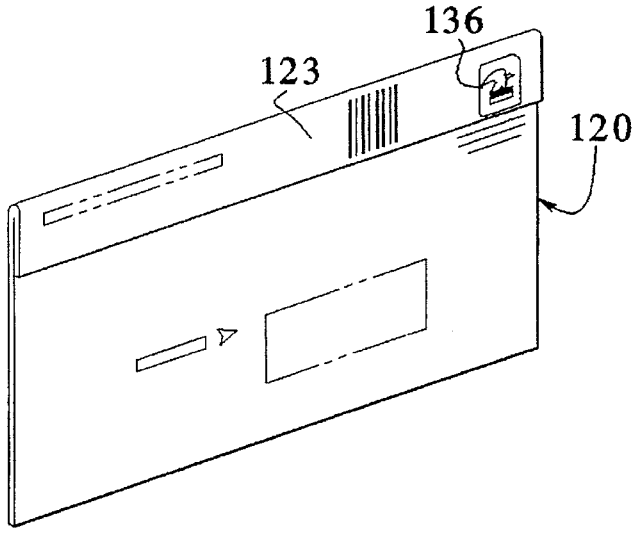
FIG. 12 illustrates a perspective view of the envelope as used in the combination of the embodiment illustrated in FIGS. 8 and 9.

Referring now to FIGS. 10–12, the package 102 with the COD mailer 100 attached thereon by the adhesive areas 108 beneath the strip 104 is shown. Following delivery of the package 102, the return envelope 120 and the return postcard 110 are removed from the package 102 along the perforated tear lines 117*a*, 117*b*, 128*a* and 128*b* so as to remove the return postcard 110 and the return envelope 120 as shown in FIG. 10. The addressee receipt 130 may remain attached to the package 102 or removed from the package 102 by separating the addressee 130 from the strip 104 along the perforated tear line 128*a*.

Referring now to FIGS. 11 and 12, the return postcard 110 is detachable from the return envelope 120 along the perforated tear line 117*b*. The return postcard 110, as illustrated, has the peelable label 115 removed therefrom and is shown attached to the check or money order 134. The check or money order 134 is inserted through the access opening 122 into the interior compartment 121 of the return envelope 120. The peelable section 125 of the sealing flap 123 is removed exposing the adhesive 126 and sealing the return envelope 120 as shown in FIG. 12. The return envelope 120 including the mailer's receipt from the peelable section 125 and the check or money order 134 or other like payment received within the interior compartment 121 of the return envelope 120 is then ready to be mailed to the sender of the article.

As shown in FIG. 12, postage 136 necessary for mailing the return postcard is, in an embodiment, printed on the sealing flap 23. When the sealing flap 23 is folded and sealed, the postage 136 and the return address also printed on the sealing flap 123 are on the side of the return envelope 120 including the mailer's address.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An assembly for delivering a mailing attached to an article requiring special services, the assembly comprising:

a form capable of printing with information related to the special services required for the mailing of the article;

a return envelope detachably connected to the form having an interior compartment;

means for securing the form and the return envelope as an integral combination to the article for delivery; and perforated tear lines between the form and the return envelope to selectively detach one from the other.

2. The assembly of claim 1 further comprising:

a first receipt portion detachably connected to at least one of the form and the return envelope.

3. The assembly of claim 1 further comprising:

a flap integrally formed with the return envelope capable of enclosing the interior compartment of the return envelope.

4. The assembly of claim 1 further comprising:

machine readable indicia on a portion of the form identifying the mailing.

5. The assembly of claim 1 further comprising:

a plurality of sections defining the form wherein at least one of the plurality of sections has a contrasting background shade.

6. The assembly of claim 1 wherein the required special service is Cash On Delivery.

7. A method for assembling a mailing attached to an article requiring special services, the method comprising the steps of:

providing an envelope having an interior compartment;

providing a form integral with the envelope and removably attached thereto;

securing the envelope and the form as a unit to the article for delivery; and providing a return receipt portion removably attached and integral with the unit.

8. The method of claim 7 further comprising the step of:

providing an adhesive area to secure the unit to the article.

9. The method of claim 7 further comprising the step of:

removing the envelope and the form from the article following delivery.

10. The method of claim 7 further comprising the step of:

providing a flap integral with the envelope to selectively enclose the envelope.

11. The method of claim 7 further comprising the step of:

folding the envelope against the form prior to securing the unit to the article for delivery.

12. A combined assembly for mailing of an article requiring special services, the assembly comprising:

a first portion providing a receipt for delivery personnel following mailing of the article requiring special services;

an envelope integrally formed with and detachably connected to the first portion forming a unit, the envelope having an interior compartment;

a second portion integrally formed with and detachably connected to the unit providing a receipt for an addressee of the article requiring special services;

means for securing the unit and the second portion to the article requiring special services; and a label removable from the first portion.

13. The combined assembly of claim 12 wherein the envelope is integrally formed between the first portion and the second portion.

14. An assembly for delivering a mailing attached to an article requiring special services, the assembly comprising:

a form capable of printing with information related to the special services required for the mailing of the article;

a return envelope detachably connected to the form having an interior compartment;

means for securing the form and the return envelope as an integral combination to the article for delivery; and a label removably secured to the form.

15. An assembly for delivering a mailing attached to an article requiring special services, the assembly comprising:

a form capable of printing with information related to the special services required for the mailing of the article;

a return envelope detachably connected to the form having an interior compartment;

means for securing the form and the return envelope as an integral combination to the article for delivery; and a second receipt portion detachably connected to the return envelope.

16. The assembly of claim 15 further comprising:

a plurality of sections defining the second receipt portion wherein at least one of the plurality of sections has a contrasting background shade.

17. A method for assembling a mailing attached to an article requiring special services, the method comprising the steps of:

providing an envelope having an interior compartment;

providing a form integral with the envelope and removably attached thereto;

securing the envelope and the form as a unit to the article for delivery; and providing a removable label on the form.

18. A combined assembly for mailing of an article requiring special services, the assembly comprising:

a first portion providing a receipt for delivery personnel following mailing of the article requiring special services;

an envelope integrally formed with and detachably connected to the first portion forming a unit, the envelope having an interior compartment;

a portion integrally formed with and detachably connected to the unit providing a receipt for an addressee of the article requiring special services;

means for securing the unit and the second portion to the article requiring special services; and a third portion attached to the return envelope capable of removal therefrom and providing a receipt for a mailer of the article requiring special services.

* * * * *